US006516861B2

(12) United States Patent
Allen

(10) Patent No.: US 6,516,861 B2
(45) Date of Patent: Feb. 11, 2003

(54) METHOD AND APPARATUS FOR INJECTING A FLUID INTO A WELL

(75) Inventor: Timothy J. Allen, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/726,008

(22) Filed: Nov. 29, 2000

(65) Prior Publication Data

US 2002/0062964 A1 May 30, 2002

(51) Int. Cl.[7] ..... E21B 43/40
(52) U.S. Cl. ..... 161/351; 166/89.1; 166/75.15
(58) Field of Search ..... 166/368, 382, 166/360, 89.1, 75.15, 351, 359

(56) References Cited

U.S. PATENT DOCUMENTS

| | | | | |
|---|---|---|---|---|
| 4,942,929 A | | 7/1990 | Malachosky et al. | 175/66 |
| 5,085,277 A | | 2/1992 | Hopper | 166/341 |
| 5,129,469 A | | 7/1992 | Jackson | 175/66 |
| 5,143,158 A | * | 9/1992 | Watkins et al. | 166/344 |
| 5,226,478 A | | 7/1993 | Henderson, Jr. et al. | 166/285 |
| 5,255,745 A | | 10/1993 | Czyrek | 166/347 |
| 5,339,912 A | | 8/1994 | Hosie et al. | 175/66 |
| 5,341,882 A | | 8/1994 | Hale | 166/293 |
| 5,372,199 A | | 12/1994 | Cegielski et al. | 166/368 |
| 5,544,707 A | | 8/1996 | Hopper et al. | 166/382 |
| 5,613,242 A | | 3/1997 | Oddo | 588/17 |
| 5,662,169 A | | 9/1997 | Hosie | 166/344 |
| 5,884,715 A | | 3/1999 | Reddoch | 175/66 |
| 5,971,077 A | * | 10/1999 | Lilley | 166/348 |
| 5,992,527 A | * | 11/1999 | Garnham et al. | 166/379 |
| 6,039,119 A | | 3/2000 | Hopper et al. | 166/368 |
| 6,053,252 A | * | 4/2000 | Edwards | 166/338 |
| 6,227,300 B1 | * | 5/2001 | Cunningham et al. | 166/339 |
| 6,394,194 B1 | * | 5/2002 | Queen et al. | 166/368 |

OTHER PUBLICATIONS

Ferguson et al. "Subsea Cuttings Injection Guide Base Trail" Offshore European Conference; SPE 26681, Sep. 7–10, 1993.

Saasen et al. "The First Cuttings Injection Operation Worldwide in a Subsea Annulus: Equipment and Operational Experience" SPE Annual Technical and Exhibition; SPE 48985 Sep. 27–30, 1998.

DRIL–QUIP, General Catalog, *"Special Applications, Cuttings Injection System"*, 1994, p. 34.

Brochure, Kvaerner Oil & Gas, "Subsea Wellhead System", 1999, 8 pages.

* cited by examiner

*Primary Examiner*—David Bagnell
*Assistant Examiner*—Daniel P Stephenson
(74) *Attorney, Agent, or Firm*—Michael P. Hartmann; Peter A. Bielioski

(57) ABSTRACT

An injection spool for use in the injection of a fluid, for example a slurry of drilling cuttings, into a subsea wellhead assembly has an outer housing having a central bore therethrough. The housing has a first end for connection to a wellhead assembly such that the central bore of the housing is aligned with the central bore of the wellhead assembly. An inner housing, for example an isolation sleeve, having a central bore therethrough is disposed within the central bore in the outer housing, whereby a cavity is formed between the inner housing and the outer housing. A port in the outer housing has an opening into the cavity between the inner housing and the outer housing, through which a fluid may be injected. The inner housing has a portion extending from within the outer housing beyond the first end of the outer housing for forming a cavity within a wellhead assembly to which the injection spool is connected. The cavity thus formed connects the cavity in the injection spool with an annular cavity defined by adjacent casings present in the wellhead assembly. In this way, a fluid injected into the injection spool through the port in the housing flows into an annulus between two casings in the well, from which it can be injected into an underground formation.

20 Claims, 6 Drawing Sheets

METHOD AND APPARATUS FOR INJECTING A FLUID INTO A WELL

TECHNICAL FIELD OF THE INVENTION

The present invention relates to a method and apparatus for injecting a fluid, in particular a slurry of cuttings from a well drilling operation, into a well. The method and apparatus of the present invention may be applied in, but are not limited to, the disposal of drilling muds and drilling cuttings prepared in the form of a liquid slurry.

BACKGROUND OF THE INVENTION

The drilling of an oil or gas well, for example a subsea well, results in the formation of small fragments of rock and other matter, known as cuttings, from the various formations through which the well is drilled. The cuttings are removed from the well as they are formed by the drill bit by being entrained in a drilling mud pumped down the well and returned to the surface vessel or platform. The cuttings are typically recovered from the drilling mud by a separation process and the mud reused in the well operations. In the past, at offshore locations, it has been common practice to dispose of the cuttings separated from the drilling mud in this way by dumping them in the sea. This practice has proven acceptable in the past, as the environmental impact from the negligible amounts of entrained oil based mud in the cuttings was low. Additionally, many companies have changed their practice to use synthetic drilling mud that is environmentally friendly.

Recently, however, it has become favoured to employ oil based drilling muds, as such mud formulations offer a number of advantages. For example, oil based muds improve the stability of the well bore, improve the performance of the drill bit by providing better lubrication and removal of cuttings as they are formed, and reduce the torque generated in the drill string during use. For these reasons, oil based drilling muds have been finding increasing use. While offering advantages during the drilling operation, the oil based mud formulations present a problem with respect to disposal. Cutting separated from the oil based muds after recovery from the well are inevitably contaminated with the oil based formulation. Washing the cuttings has been attempted, but only removes the mud from the surface of the cuttings particles, leaving oil in the cracks and pores of the fragments. It is no longer possible to dispose of cuttings recovered from an offshore well using oil based drilling muds in the same manner as when water based muds are employed by simply pouring the cuttings into the sea, due to a damaging environmental impact, and corresponding environmental regulations.

Accordingly, it has been the practice to dispose of the cuttings by injecting them into a well and into subsurface formations. To facilitate this, it has been the practice to grind the cuttings and suspend them in a suitable liquid to form a pumpable slurry, which may then be injected into a subsurface formation through an annulus between adjacent casings in the well. This has been common practice in environmentally sensitive areas, such as the north slope of Alaska, for many years.

U.S. Pat. No. 4,942,929 discloses a method for the disposal and reclamation of drilling wastes, in which construction grade gravel is separated from drilling cuttings produced during well drilling operations. The solids that are not so recovered are formed as a slurry with the remaining clays, silts and spent drilling fluid and conducted to a second well, remote from the well being drilled, into which the slurry is injected. Centrifugal pumps or mechanical agitators are used to disperse the fine solids in the slurry to assist in the injection process.

A drill cutting disposal method and system is disclosed in U.S. Pat. No. 5,129,469. In the method and system disclosed, drill cuttings produced during well drilling operations are brought to the surface and separated from the drilling mud, mixed with a suitable liquid, such as sea water and the mixture subjected to grinding to form a slurry. The slurry may then be pumped into a selected zone of the well for disposal.

U.S. Pat. No. 5,341,882 discloses a method for the disposal of well drilling cuttings, in which the cuttings are solidified by combining the cuttings with water and blast furnace slag. The resulting mixture is injected into the annulus between two wellbore casings, where it solidifies to form a cement.

U.S. Pat. No. 5,255,745 describes a method and apparatus for providing a remotely operable connection to establish access to an annulus within a wellhead assembly. The apparatus requires a port in the wellhead assembly. A valve is positioned to seal with the port by remote means using a ramp assembly supported on a guide base positioned around the wellhead.

U.S. Pat. No. 5,884,715 discloses a method and apparatus for injecting cuttings into a well while drilling operations are in progress. Two embodiments are discussed in the disclosure. The first method requires a predrilled well bore to be bored adjacent to and extending away from the well being drilled. The predrilled well bore is used as a depository for the drilling cuttings produced from the well being drilled. The second embodiment requires an injection tube to be installed within the well being drilled alongside the casings set into the well, through which access can be gained to subsurface formations into which the cuttings may be injected. A further embodiment employs an annulus between adjacent casings in the well in order to gain access to underground formations. It is noted that the embodiments disclosed in U.S. Pat. No. 5,884,715 relate to the injection of cuttings into a well having a wellhead accessible on land. While subsea operations are mentioned, little information is given regarding the injection of cuttings into subsea wells.

A subsea wellhead typically comprises a conductor pipe extending below the sea bed in the well, the upper portion of which extends from the well and forms a conductor housing. A high pressure housing is landed in the conductor housing, on which is typically mounted a blowout preventer (BOP) stack by means of a BOP guide funnel. Successively smaller casings are landed in the wellhead, suspended from casing hangers secured within the conductor pipe or the high pressure housing. A guide base is often employed, which comprises a structure extending around the wellhead and mounted to the conductor housing.

A subsea well injection system is disclosed in U.S. Pat. No. 5,085,277, for injecting unwanted slurries and other fluids arising from drilling or other downhole operations into a subsea well. The slurry or other fluid is injected through a drilling guide base positioned around the well on an underwater surface. The system employs a dedicated guide base, which comprises pipework on the guide base leading to a port in the conductor casing of the well, thus gaining access to the annulus between the conductor casing and the adjacent inner casing. A fail safe isolation valve is provided on the guide base and joined to the pipework. A coupling is provided to connect the isolation valve to a surface vessel or platform. The wellhead is modified to provide a port in the housing, in order to gain access to an annulus between casings within the well. With a single port in the outermost casing of the well, fluids may be injected into the outermost annulus of the well. If access is required to an inner annulus, similar ports are required in the casings disposed radially outwards of the inner annulus to provide a flow path to the pipework extending from the guide base.

In U.S. Pat. No. 5,339,912, there is disclosed a cuttings disposal system in which an injection adapter is employed to allow a slurry of cuttings to be injected into a well. The well, designated an "injection well", has an inner and an outer wellhead housing with at least one casing hanger and a respective inner casing installed in the inner wellhead housing. The casing hanger is formed with a port through it, connecting the bore of the well with the annulus between the inner casing and the outer casing of the well. When it is desired to inject cuttings into the well, an injection adapter is landed in the wellhead so as to extend into the bore of the well, allowing a central bore in the injection adapter to connect, through a port in the side of the injection adapter body, with the port in the casing hanger. The central bore in the injection adapter is connected by pipework to a pump at the surface, by means of which a slurry of cuttings may be injected through the injection adapter and into the annulus in the well. It is noted that, with the injection adapter landed in the well, access to the well for conducting other operations is denied, until the cuttings injection operation is ceased and the injection adapter removed.

A cuttings injection wellhead system for use in subsea wells is disclosed in U.S. Pat. No. 5,662,169. The wellhead system employs a wellhead having a conductor casing, to which is mounted a conductor housing and around which a guide base is provided. A high pressure housing is landed in the conductor housing. The wellhead system comprises an extension to the conductor housing extending between the lower end of the conductor housing and the conductor casing. A port is formed in the conductor housing extension below the guide base, allowing access to the interior of the conductor housing. A similar extension is provided on the lower end of the high pressure housing, formed with a corresponding port aligned with the port in the conductor casing. An inner casing is suspended from a casing hanger disposed within the high pressure housing. The ports in the extensions to the conductor housing and high pressure housing provide access to the annulus around the inner casing, into which a slurry of drilling cuttings may be injected. The pipework necessary to connect with the port in the conductor housing extension depends from the guide base provided around the wellhead assembly. The wellhead system of U.S. Pat. No. 5,662,169 requires the use of a modified conductor housing and high pressure housing, both of which must be provided with extensions through which aligned ports must be bored. In addition, the system of U.S. Pat. No. 5,662,169 requires the use of a dedicated guide base with the necessary pipework and connections in order to allow cuttings injection to proceed.

In a paper entitled "Subsea Cuttings Injection Guide Base Trial" presented at the Offshore European Conference, Sep. 7 to 10, 1993, Ferguson et al. disclosed the results of field trials conducted to test a permanent guide base and wellhead assembly modified to allow cuttings injection. A modified permanent guide base was employed having a pipe connecting through the guide base to a port in an extension welded to the conductor housing of the wellhead. A similar extension was provided on the lower end of the high pressure housing, through which a port was formed to align with the port in the extension to the conductor housing and provide access to an inner annulus of the wellhead assembly. As with the system of U.S. Pat. No. 5,662,169, a dedicated guide base is required in this system in order to provide the possibility of cuttings injection, together with modifications to several of the wellhead components.

A similar cuttings injection system is disclosed by Saasen et al. in a paper entitled "The First Cuttings Injection Operation Worldwide in a Subsea Annulus: Equipment and Operational Experience", presented at the SPE Annual Technical Conference and Exhibition, Sep. 27 to 30, 1998. Again, this system employs a modified guide base, required to be larger than conventional guide bases, through which access is gained to a port formed in the conductor housing. A similar port is provided in the high pressure housing, aligned with the port in the conductor housing, in order to access an annulus between the high pressure housing, and its associated casing, and a casing suspended from a casing hanger secured in the bore of the high pressure housing. Again, the system of Saasen et al. requires a modified, dedicated guide base to be provided in order to inject cuttings into an annulus within the wellhead assembly. Further, in the system of Saasen et al. seal cartridges are required to be provided within the conductor housing around the high pressure housing both above and below the ports in the conductor housing and high pressure housing, in order to avoid ingress of the cuttings slurry into the annulus between the conductor housing and the high pressure housing.

It is noted that the prior art teaches, in general, that it is required to employ a dedicated guide base in order to effect cuttings injection into a subsea wellhead. Further, the systems proposed required significant modifications to the components of the wellhead assembly in order to provide access to the annulus of choice within the well. In particular, a number of the prior art proposals require an access port to be formed in the wellhead assembly. There is clearly a need for a way to inject drilling cuttings into a well, while keeping the modifications required to the conventional or existing equipment to a minimum. Further, it would be most advantageous to be able to operate a cuttings injection procedure in a well without requiring a guide base to be present. It would be of further advantage if the system for cuttings injection could be operated in a well while drilling and other well operations were proceeding at the same time.

SUMMARY OF THE INVENTION

According to a first aspect of the present invention there is provided an injection spool for use in the injection of a fluid into a wellhead assembly, the wellhead assembly having a central bore therethrough, the injection spool comprising:

an outer housing having a central bore therethrough, the housing having a first end for connection to a wellhead assembly such that the central bore of the housing is aligned with the central bore of the wellhead assembly;

an inner housing having a central bore therethrough, the inner housing being disposed within the central bore in the outer housing, whereby a cavity is formed between the inner housing and the outer housing;

a port in the outer housing having an opening into the cavity between the inner housing and the outer housing;

the inner housing having a portion extending from within the outer housing beyond the first end of the outer housing for forming a cavity within a wellhead assembly to which the injection spool is connected, the cavity thus formed connecting the cavity in the injection spool with an annular cavity defined by adjacent casings present in the wellhead assembly.

The injection spool of the present invention may be installed directly on a subsea wellhead assembly. Once installed, the injection spool provides access to an annular cavity between adjacent casings suspended in the wellhead assembly and extending into the well. In this way, fluids, such as a slurry of drilling cuttings may be injected into the injection spool housing and pumped through the annular cavity between the casings into the underground formations into which the casings extend. Ancillary equipment necessary for injecting fluids into the injection spool, such as isolation valves and a connection for a riser, is connected directly to the port in the outer housing of the injection spool. A guide base is not required in order to carry out the injection operations. Indeed, a guide base need not be present at the wellhead site, unless required for the performance of other duties. The installation and operation of the injection spool of the present invention requires can be accomplished with no modifications to the existing wellhead assembly or to the conventional wellhead assembly components. If modifications to the components of the wellhead assembly are required, such modifications are only very minor.

The outer housing of the injection spool may be connected to the wellhead assembly at its first end by a connector, the design of which is well known in the art for connecting wellhead components. In one preferred embodiment, the connector is formed as an integral part of the first end of the injection spool outer housing. In a preferred arrangement, the connector is arranged for installing the injection spool on the high pressure housing of a subsea wellhead assembly.

The inner housing extends from within the outer housing of the injection spool. The inner housing is preferably formed to connect with a casing within the wellhead assembly onto which the injection spool is installed. Preferably, the connection between the inner housing and the casing within the wellhead assembly is achieved by having the end of the inner housing extending within the wellhead seal against a casing hanger suspending the respective casing in the wellhead assembly.

In a preferred embodiment, the inner housing is a sleeve, separate from the outer housing of the injection spool, secured at a first end within the central bore in the outer housing. A seal is preferably provided around the first end of the sleeve between the sleeve and the outer housing, in order to seal the upper end of the annular cavity with the injection spool. The sleeve functions to isolate the annular cavity within the injection spool from the central bore of the spool. In addition, the sleeve may be arranged to act as a wear bushing for protecting the injection spool and that portion of the wellhead assembly into which the sleeve extends from damage and erosion by drilling tools and other equipment moving through the bore in the injection spool and the wellhead assembly.

The injection spool may be assembled with the sleeve secured in the central bore of the spool prior to the installation of the injection spool on a subsea wellhead. Alternatively, the injection spool may be installed on a subsea wellhead assembly with just the outer housing being put in place, and the sleeve installed thereafter. In such a case, the outer housing is formed in order to allow the sleeve to be landed in and installed in the injection spool when in place on a wellhead assembly. In this arrangement, the inner housing may be formed by a casing installed in and suspended from the injection spool, for example using a conventional casing hanger secured in the central bore of the outer housing of the injection spool.

The injection spool may comprise a second inner housing extending concentrically within the first inner housing. The second inner housing may be arranged as described above with respect to the first inner housing. In this way, an annular cavity is formed between the first and second inner housings, which may be used to connect with a further annular cavity between adjacent casings within the wellhead assembly and the well. In such an arrangement, a further port is provided in the outer housing, to access the annular cavity between the first and second inner housings.

Further inner housings may be provided in a similar manner, in order to access additional annuli between adjacent casings within the wellhead assembly and the well.

With respect to the aforementioned embodiment of the invention in which one or more sleeves are provided, the present invention provides, in a further aspect, a spool for injecting fluids into a cavity in a wellhead assembly on which the spool is installed, the spool comprising:

- a spool housing having a central bore therethrough, the spool housing having a first end for connection to a wellhead assembly;
- a port in the spool housing having an opening into the central bore of the spool housing;
- a retainer, whereby a sleeve may be secured in the central bore of the spool housing at a first end, such that a cavity is formed between the sleeve and the spool housing and the opening of the port in the spool housing communicates with the cavity.

The first end of the spool may comprise a connector for installing the spool on a wellhead assembly. In one embodiment, the connector is for connecting the spool to the high pressure housing of a subsea wellhead assembly.

The retainer may be any form of arrangement for securing the end of a sleeve or casing within the spool, for example a groove or shoulder within the central bore of the spool onto which the sleeve or casing may be landed.

The spool may comprise a second retainer, to which a second sleeve may be secured, thereby forming a further cavity within the spool. A further port is preferably provided to gain access to this further cavity. Additional retainers for further additional sleeves may be provided on a similar basis.

In a further aspect, the present invention provides a wellhead assembly in a well, the wellhead assembly having a central bore therethrough in communication with the well, the wellhead assembly comprising:

- a wellhead housing;
- a first casing extending into the well;
- a second casing extending within the first casing into the well;
- an annular cavity defined between the first and second casings, through which access can be gained to a subsurface formation;
- an injection spool housing connected at a first end to the wellhead housing and having a central bore therethrough in communication with the central bore of the wellhead assembly;
- an inner housing extending from within the central bore of the injection spool housing into the central bore of the wellhead housing;
- a first cavity formed between the inner housing and the injection spool housing;
- a second cavity formed between the inner housing and the wellhead housing and communicating with the first cavity and the annular cavity between the first and second casings; and
- a port in the injection spool housing opening into the first cavity.

One or both of the first and second casings may be supported with the wellhead assembly by means of a casing hanger. If the second casing is supported in such a manner, the casing hanger is preferably provided with one or more ports therethrough, allowing the second cavity to communicate with the annular cavity.

Alternatively, the first casing may be supported with the wellhead housing and the second casing supported below the wellhead housing by means of a casing hanger landing below the housing. In this arrangement, the inner housing extends though the bore of the wellhead housing and interfaces with the casing hanger below the wellhead housing, in the manner described above.

In general, it is to be noted that the wellhead assembly may comprise a plurality of casings, none, some or all of which are supported using casing hangers. The inner housing may be arranged to seal in any of the seal pockets in the wellhead assembly.

The wellhead assembly may also comprise a first inner housing and a second inner housing, arranged concentrically, both of which are secured at their first ends within the outer housing of the injection spool housing, and both of which extend from within the injection spool housing into the wellhead housing to seal at their second ends with respective casings within the wellhead assembly. In this arrangement, a further cavity is formed between the first and second inner housings, which communicates with a further annulus between adjacent casings within the wellhead extending into the well. The innermost housing of the first and second inner housings will interface with and seal with a casing of smaller diameter than the outermost of the two housings. A second port is provided in the injection spool housing to communicate with the further cavity, in the manner as described above. In this way, the injection spool provides access to two annuli extending from the wellhead assembly into the well, allowing access to further underground formations within the well.

In the same manner, a third and further inner housings may be provided, in order to provide access to further annuli within the wellhead assembly and the well.

As noted above, the inner housing may be a sleeve, secured at a first end within the injection spool housing and extending into the wellhead housing. A seal is preferably disposed around the first end of the sleeve in order to seal the end of the first cavity.

As also noted, the second end of the sleeve preferably connects to the second casing within the wellhead housing, in particular by contacting the casing hanger supporting the second casing within the wellhead assembly.

The sleeve preferably serves as a wear bushing, protecting the central bore of the injection spool housing and the wellhead housing from wear and erosion caused by the passage of drilling tools and other equipment through the wellhead assembly into and out of the well.

A cuttings riser interface assembly is preferably connected to the port in the injection spool housing, allowing a cuttings injection riser to be extended from a surface vessel or platform to connect with the injection spool on the wellhead assembly. The cuttings riser interface assembly preferably comprises a valve for isolating the first cavity from the exterior of the wellhead assembly.

According to a still further aspect of the present invention, there is provided a method for injecting drilling cuttings into an underground formation through a wellhead assembly having a central bore therethrough situated on a well in the formation, the method comprising:

providing an injection spool installed on the wellhead assembly, the injection spool having a central bore therethrough in communication with the central bore in the wellhead assembly;

providing a first cavity within the injection spool, while maintaining the central bore therethrough open;

providing a second cavity within the wellhead assembly in communication with the first cavity and an annular cavity between two adjacent casings extending from the wellhead assembly into the underground formation;

providing a port in the injection spool in communication with the first cavity; and injecting a slurry of the drilling cuttings through the port in the injection spool into the first cavity.

It is an advantage of the injection spool of the present invention that the central bore therethrough remains open while the injection of cuttings into the well takes place, in turn allowing access to the bore of the wellhead assembly and the well below. Accordingly, the cuttings injection method of the present invention may be operated while other well operations are being carried out in the wellhead assembly and the well. In particular, the injections of cuttings may be carried out while further drilling of the well is taking place.

Specific embodiments of the apparatus and method of the present invention will now be described in detail having reference to the accompanying drawings. The detailed description of these embodiments and the referenced drawings are by way of example only and are not intended to limit the scope of the present invention.

BRIEF DESCRIPTION OF THE DRAWINGS

Preferred embodiments of the present invention will now be described, by way of example only, having reference to the accompanying drawings, in which.

DETAILED DESCRIPTION OF THE PREFERRED EMBODIMENTS

Figure 1:
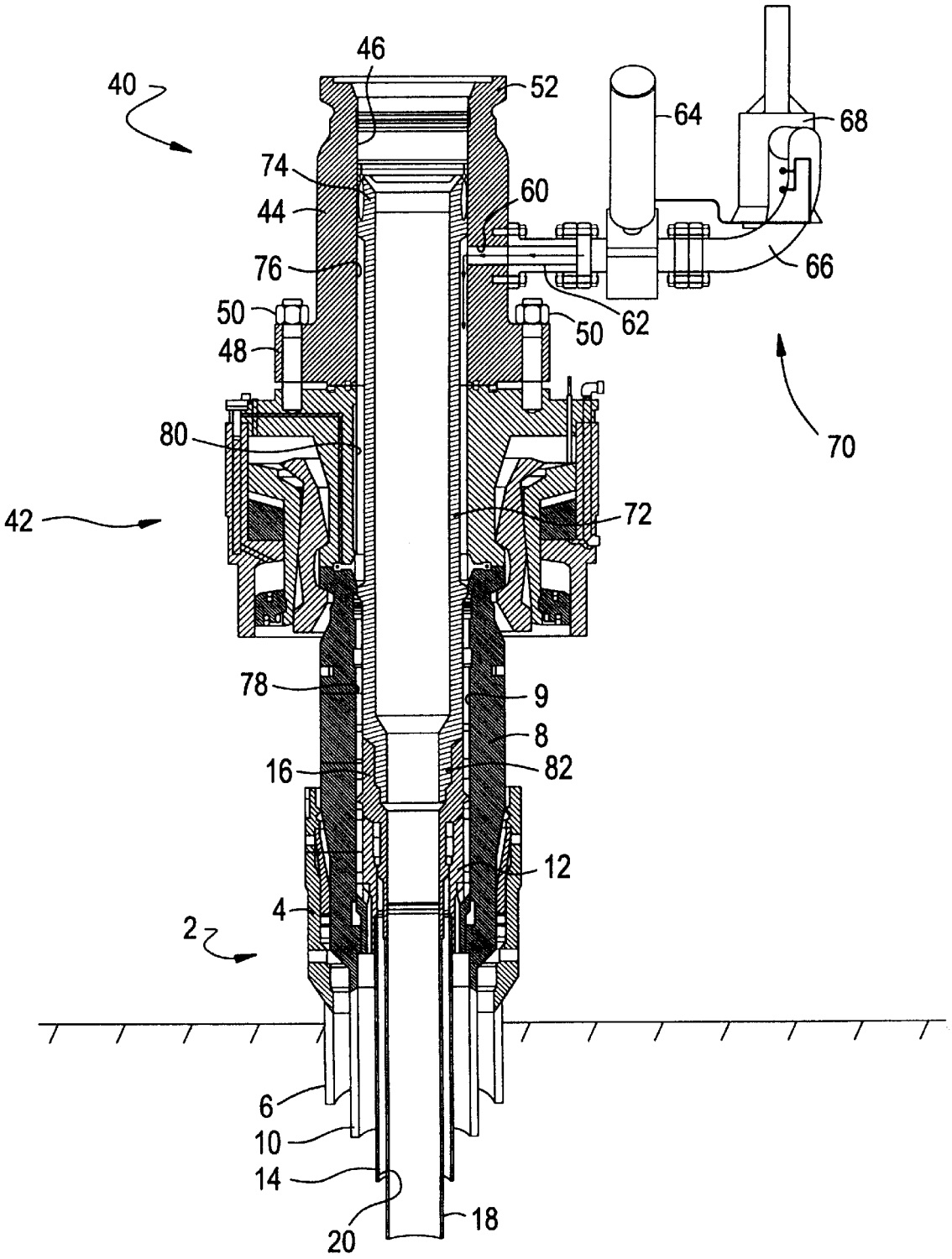
FIG. 1 is a side elevation cross-sectional view of an injection spool of one embodiment of the present invention in place on a wellhead assembly.

Referring to FIG. 1, a wellhead assembly of conventional design is shown and generally indicated as 2 in place on a subsea well. The wellhead assembly 2 comprises a conductor housing 4, from which extends a conductor casing 6 extending into the well. A high pressure housing 8, having a central bore 9 therethrough, is installed in the conductor housing 4 in a conventional manner. A high pressure casing 10, typical having a nominal diameter of 20 inches, extends from the lower end of the high pressure housing 8 into the well. A first casing hanger 12 of conventional design is secured in the bore of the high pressure housing 8 and supports a first inner casing 14, which extends into the well within the high pressure casing 10. The first inner casing 14 typically has a nominal diameter of 13⅜ inches. A second casing hanger 16 is disposed in a conventional manner in the bore of the high pressure housing 8 above the first casing hanger 12. The second casing hanger 16 is of a modified design, as described in greater detail hereinbelow. The second casing hanger 16 serves to support a second inner casing 18, extending within the first inner casing 14 into the well.

In the arrangement shown in FIG. 1, the wellhead assembly and casing strings are assembled to leave open the annular cavity, indicated as 20, between the first inner casing 14 and the second inner casing 18. This is achieved by installing the casings 14 and 18 in the well without cementing between them. In this way, access is obtained through the annular cavity 20 to the underground formation into which the first inner casing 14 extends and the annular cavity 20 opens. The arrangement shown in FIG. 1 allows fluids, in particular a slurry of cuttings to be injected into the wellhead assembly 2, through the annular cavity 20 and into the aforementioned underground formation. It will be appreciated that the injection spool of the present invention, as described below, may be used to inject fluids, such as a slurry of drilling cuttings, into other annular cavities within the wellhead assembly 2 and the well.

The injection spool of the embodiment of FIG. 1 and its method of use will now be described.

Referring again to FIG. 1, an injection spool, generally indicated as 40, is installed by way of a connector, generally indicated as 42, on the high pressure housing 8 of the wellhead assembly 2. The injection spool 40 comprises a generally cylindrical injection spool housing 44 having a central bore 46 therethrough. The injection spool housing 44 has a flange 48 at its first end, through which bolts 50 pass to secure the injection spool 40 to the upper portion of the connector 42. Alternatively, a threaded or clamped connection could be used in place of the bolted flange connection. The second end 52 of the injection spool housing 44 is of conventional design, allowing other wellhead assemblies, such as a blowout preventer (BOP) stack, to be supported by conventional means. The second end 52 of the injection spool housing shown in FIG. 1 is of the type commonly referred to as a hub. Alternatively, a mandrel type housing, well known in the art, may also be employed. In this way, the injection spool 42 may be placed between the wellhead assembly 2 and another assembly, such as a BOP stack, in a conventional or existing subsea wellhead installation, with no modifications to either the wellhead assembly or the BOP stack being required. Alternatively, the second end 52 of the injection spool housing 44 shown in FIG. 1 can be configured with a flange and attached directly as an integral component of a BOP stack.

The connector 42, connecting the injection spool 40 to the high pressure housing 8 of the wellhead assembly is of conventional design, such connectors being well known to the person skilled in the art. The connector 42 shown in FIG. 1 is of the hydraulic type, actuated by hydraulic fluid supplied through hydraulic control lines (not shown) extending from a surface vessel or platform.

The injection spool 40 comprises a port 60 extending through the injection spool housing 44 and opening into the central bore 46. The port 60 is shown in FIG. 1 to be extending radially through the injection spool housing 44, that is perpendicular to the longitudinal axis of the central bore 46 and the injection spool 40. However, it will be understood that the port 60 may extend through the injection spool housing 44 at an oblique angle, as required by the external arrangement of the wellhead assembly and the associated equipment. An outlet spool 62 is bolted to the exterior of the injection spool housing 44 and has a central bore therethrough, which communicates with the port 60 in the spool housing 44. A valve 64 is mounted on the outlet spool 62, by means of which the port 60 may be sealed from the exterior, for example in the case of an emergency. The valve 64 may be any of the conventional forms of valve known for use in subsea applications. The valve 64 is preferably a fail-safe closed valve, thus allowing the port 60 to be closed automatically in the case of an emergency. A flow loop 66 connects the valve 64 to a cuttings riser interface 68, onto which a cuttings riser (not shown) extending from the surface vessel or platform may be landed. The valve 64, flow loop 66 and cuttings riser interface 68 comprise a riser interface assembly, generally indicated as 70, through which the flow of cuttings slurry into the injection spool 40 and the wellhead assembly 2 is passed and controlled.

An isolation sleeve 72 is secured at a first end 74 within the central bore 46 of the injection spool housing 44, with the first end 74 of the isolation sleeve 72 being positioned with the port 60 between the first end 74 and the wellhead assembly 2, that is above the port 60 in FIG. 1. The isolation sleeve 72 thus forms an inner housing within the injection spool housing 44, with a first annular cavity 76 being formed between the isolation sleeve 72 and the spool housing 44. As shown in FIG. 1, the isolation sleeve 72 extends beyond the flange 48 at the first end of the injection spool housing 44, through the connector 42 and into the central bore 9 of the high pressure housing 8. A second annular cavity 78 is formed between the isolation sleeve 72 and the high pressure housing 8, which connects with the first annular cavity 76 in the injection spool 40 by way of an annular cavity 80 extending between the isolation sleeve 72 and the housing of the connector 42. The isolation sleeve 72 abuts at a second end 82 the second casing hanger 16.

Figure 2:
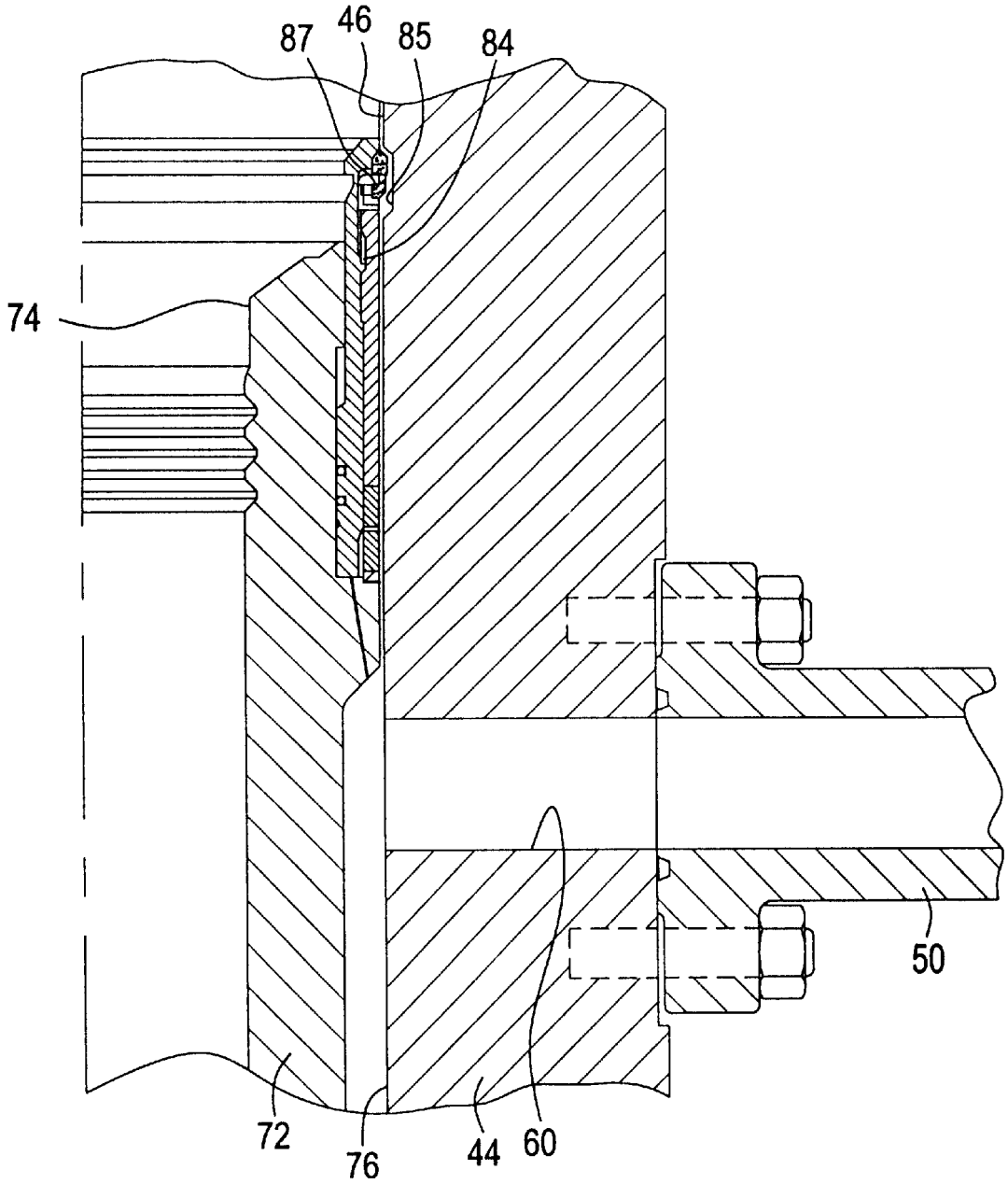
FIG. 2 is a detailed view of a first portion of the injection spool of FIG. 1.

Referring to FIG. 2, there is shown a detailed view of the first end 74 of the isolation sleeve 72 within the central bore 46 of the injection spool housing 44. The first end 74 of the isolation sleeve is secured within and sealed to the injection spool housing 44 by means of an annular pack-off 84. The annular pack-off 84 is of conventional design, well known in the art, for example for sealing casing hangers within wellhead assemblies and the like. The annular pack-off 84 serves to retain the first end 74 of the isolation sleeve 72 within the central bore 46 and seal the upper end of the first annular cavity 76 within the injection spool housing 44, thereby isolating the first annular cavity 76 from the central bore 46 of the injection spool housing 44. A groove 85 is provided in the bore 46 of the injection spool housing 44, into which the annular pack-off 84 is seated and retained by means of a locking ring 87. Alternatively, the annular pack-off 84 may be retained in the housing by various other means, including but not limited to threading, cold forging and other techniques well known in the art.

Figure 3:
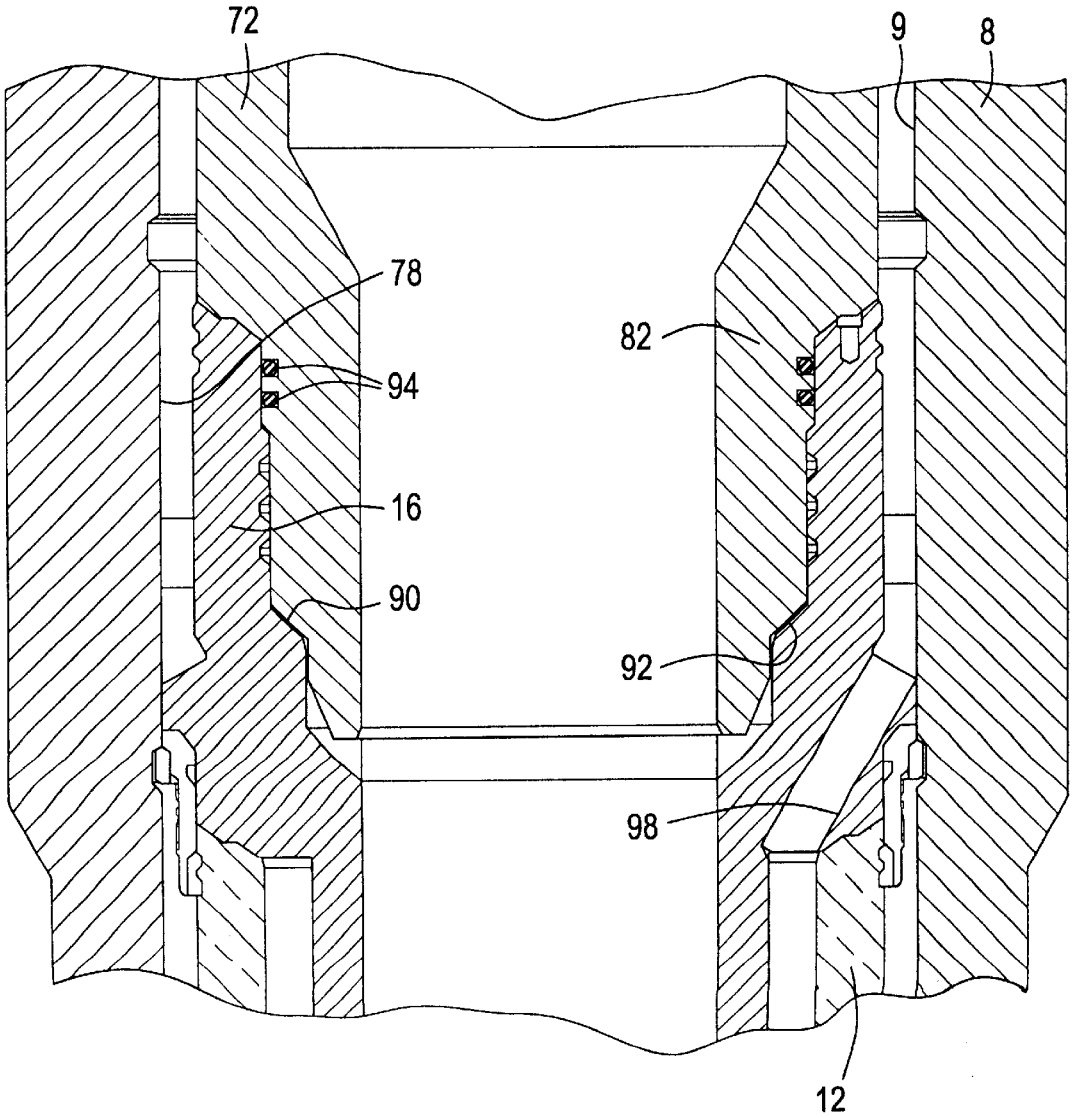
FIG. 3 is a detailed view of a second portion of the injection spool of FIG. 1.

Referring now to FIG. 3, there is shown a detailed view of the second end 82 of the isolation sleeve 72. The second end 82 of the isolation sleeve 72 contacts the second casing hanger 16. The second casing hanger 16 is of substantially conventional design and has an inner profile 90 comprising a plurality of discontinuous tapered surfaces, such that the bore of the casing hanger tapers generally from its end in the direction of the well. The second end 82 of the isolation sleeve 72 has an outer profile 92 comprising a plurality of discontinuous surfaces corresponding to those making up the inner profile 90 of the second casing hanger 16. In this way, the second end 82 of the isolation sleeve 72 is seated within the second casing hanger 16 and provides a smooth transition from the central bore of the isolation sleeve to the bore of the second casing hanger 16 and the second inner casing 18 below it. Seals 94 are retained in grooves in the outer surface of the second end 82 of the isolation sleeve and contact the inner surface of the second casing hanger 16, thereby isolating the central bores of the isolation sleeve 72 and the second casing hanger 16 from the second annular cavity 78. Alternatively, the isolation sleeve can be sealed to the second casing hanger 16 by other means well known in the art.

The second casing hanger 16 is retained in the bore of the high pressure housing 8 by conventional means, such that a shoulder 96 extending radially outwards from the second casing hanger 16 bears against the first casing hanger, that in turn bears on the inside of the high pressure housing. The second casing hanger may be retained primarily by weight or retained by any of the various other means of securing a hanger into a wellhead well known in the art. A conventional wellhead casing hanger pack-off 99 acts to close the second annular cavity 78, preventing it from communicating with the annular cavity between the first inner casing 14 and the high pressure casing 10. Accordingly, one or more ports 98 are formed through the second casing hanger 16 in order to allow the second annular cavity 78 to communicate with the annular cavity 20 between the first inner casing 14 and the second inner casing 18.

In operation, a fluid to be injected into an underground formation accessed by the well, such as a slurry of drilling cuttings, is prepared on the surface vessel or platform or, if produced at a second location, transported to the surface vessel or platform. A slurry of drilling cuttings may be prepared using the techniques known in the art and described, for example, in the prior art discussed above. Generally, this will involve separating from the drilling cuttings the larger fragments, for use as gravel in construction or the like, and/or grinding the drilling cuttings into fine fragments, which are then slurred with an appropriate liquid, for example a used drilling mud. At offshore locations, it is typical to grind the drilling cuttings to produce fragments fine enough to be slurried, as the costs of transporting the larger fragments as gravel to a location where they can be used is generally prohibitive.

Once the fluid, such as the slurry of drilling cuttings is present at the surface vessel or platform, it is pumped through a riser connected to the riser interface 68 of the riser interface assembly 70. Flow of the fluid is controlled by the valve 64, allowing the fluid to be fed to the spool 62 and the port 60 in the injection spool housing 44. From the port 60, the fluid enters the first annular cavity 76 and flows down through the injection spool 40, through the bore in the connector 42 and into the second annular cavity 78 within the high pressure housing 8 of the wellhead assembly 2. From here, the fluid passes through the port 98 in the second casing hanger 16 and into the annular cavity 20 between the first inner casing 14 and the second inner casing 18. The fluid will leave the annular cavity 20 at the lower end of the first inner casing 14 and enter the underground formation at this point. Alternatively, the first inner casing 14 may be perforated along its length, in order to allow further access points for the fluid to enter one or more underground formations.

As already noted, it is an advantage of the present invention that the injection spool 44 may be installed on a wellhead assembly with little modification required to the conventional or existing wellhead equipment. In particular, the injection spool 44 of the present invention allows access to the central bore of the wellhead assembly 2 to remain open and, hence, the well to remain accessible from the surface vessel or platform, even while fluid injection operations are taking place. In this respect, it is possible to employ the method and apparatus of the present invention to inject fluid into underground formations accessed by the well, while drilling and other downhole operations are in progress, without the need to interrupt the said operations to either start or discontinue fluid injection. As a further advantage, the embodiment of the present invention shown in FIG. 1 allows the isolation sleeve 72 to act as a wear bushing within the bore of the injection spool 40, the connector 42 and the high pressure housing 8. In this way, the isolation sleeve serves to protect the inner walls of the aforementioned components from wear and damage caused by the passing of tools, such as drilling bits and the like, into the well.

The embodiment of FIG. 1 is shown with a separate isolation sleeve 72, extending from within the injection spool housing 44 into the high pressure housing 8 to contact the second casing hanger 16. It is possible to dispense with the isolation sleeve and, once the injection spool 40 is in place on the wellhead assembly 2, to install the second casing hanger 16 within the injection spool housing 44 to suspend the second inner casing 18. In this way, the second casing hanger 16 and the second inner casing 18 will form the inner walls of the first and second annular cavities 76 and 78 within the injection spool housing 44 and the high pressure housing 8 respectively. In this way, the injection spool of the present invention may be used in conjunction with conventional wellhead assembly components, with no modification of the latter being required before installation.

Figure 4:
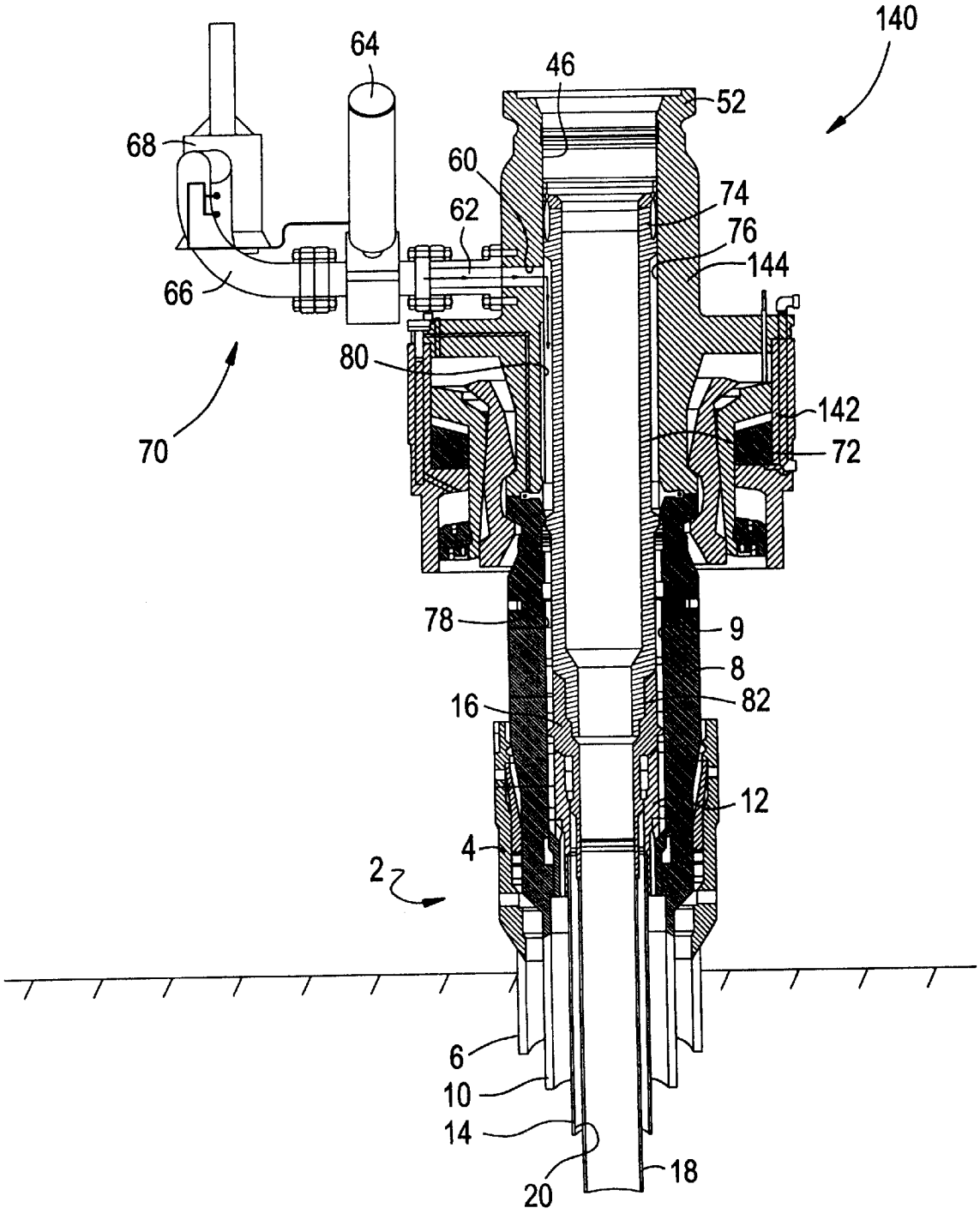
FIG. 4 is a side elevation cross-sectional view of an injection spool of a second embodiment of the present invention in place on a wellhead assembly.

Referring to FIG. 4, there is shown a second embodiment of the injection spool of the present invention, in place on a subsea wellhead assembly. Components of the embodiment of FIG. 4 common to the embodiment of FIG. 1 are indicated using the same reference numerals and are as described above. In the embodiment of FIG. 4, the injection spool, generally indicated as 140, is formed as a unitary component with the connector 142. The injection spool housing 144 extends to provide the inner housing of the connector 142 and is seated directly on the high pressure housing 8. The components and function of the connector 142 are as shown in the embodiment of FIG. 1 and are well known in the art.

Figure 5:
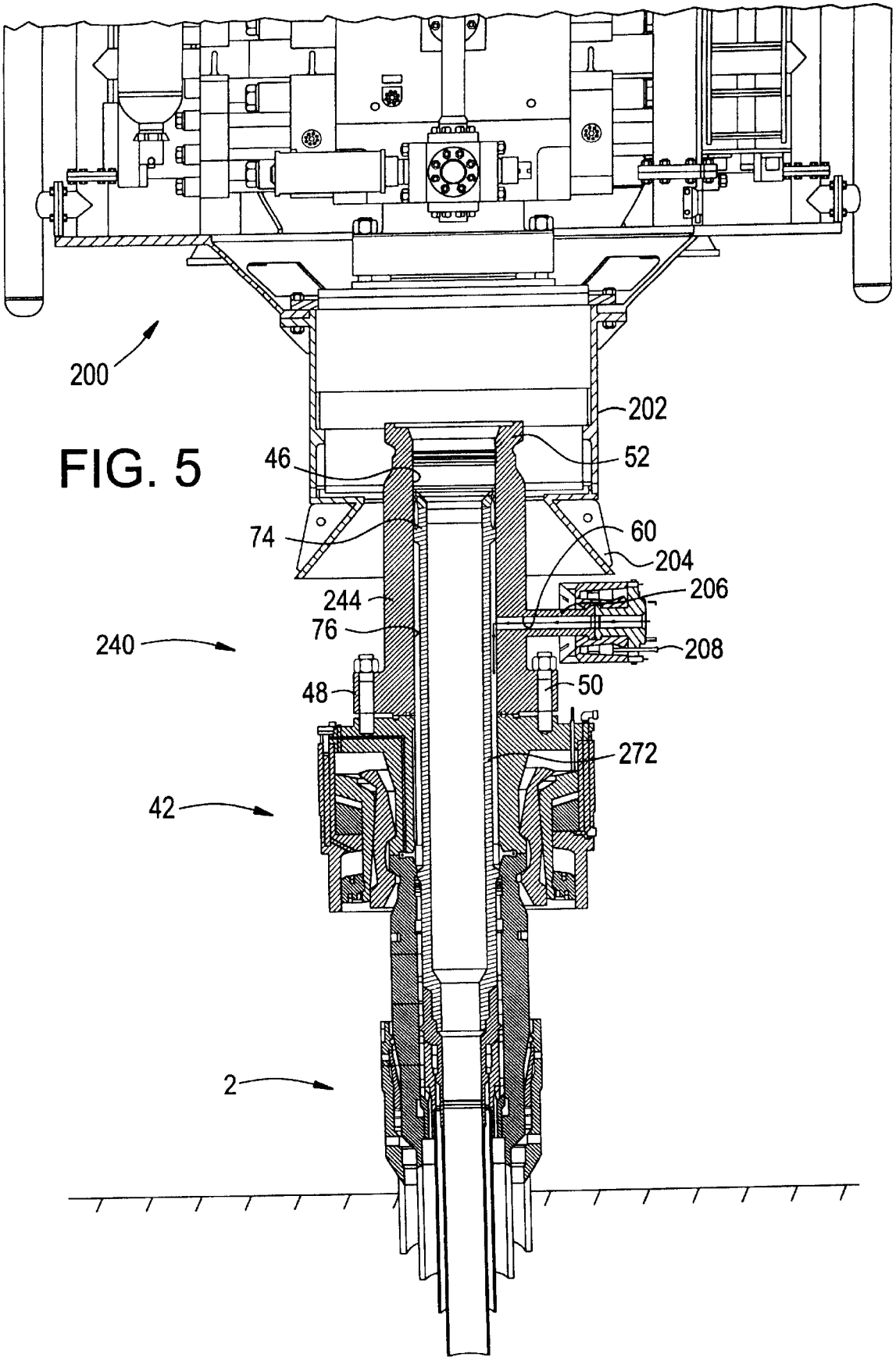
FIG. 5 is a side elevation, partial cross-sectional view of a further embodiment of the injection spool of the present invention, in place on a subsea wellhead assembly.

Referring to FIG. 5, there is shown a further embodiment of the injection spool of the present invention, in place on a subsea wellhead assembly. In FIG. 5 there is shown a wellhead assembly 2 and connector 42 as shown in FIG. 1 and described above. The connector 42 secures an injection spool 240 according to the present invention to the wellhead assembly 2. The components of the injection spool 240 of FIG. 5 common to the injection spool of FIG. 1 are indicated using the same reference numerals and are as described above. A blowout preventer (BOP) stack, generally indicated as 200, is shown in FIG. 5 mounted to the injection spool 240. The BOP stack 200 is of conventional design and is secured to the injection spool 240 by a BOP stack connector 202 of conventional design. A BOP stack connector guide funnel 204 extends from the BOP stack connector 200 down and around the upper portion of the injection spool 240 and serves to locate the BOP stack connector onto the injection spool 240 during the installation of the BOP stack 200.

In order to accommodate the BOP connector guide funnel 204, the injection spool 240 has an extended injection spool housing 244. In addition, an extended isolation sleeve 272 is provided, secured within the central bore 46 of the extended injection spool housing 244 as described above and shown in FIGS. 1 and 2.

The extended injection spool housing 244 comprises a port 60 extending from the exterior and opening into the first annular cavity 76 between the extended isolation sleeve 272 and the extended injection spool housing 244. The injection spool 240 of FIG. 5 incorporates an alternative arrangement for the connection to the port 60 to that shown in FIG. 1. An injection spigot 206 extends outwards from the extended injection spool housing 244 in communication with the port 60. A riser interface assembly is provided as shown in FIG. 1 and described above (omitted from FIG. 5 for clarity). A hydraulic connector 208, of conventional design, is provided to connect the riser interface assembly to the injection spigot 206.

Figure 6A:
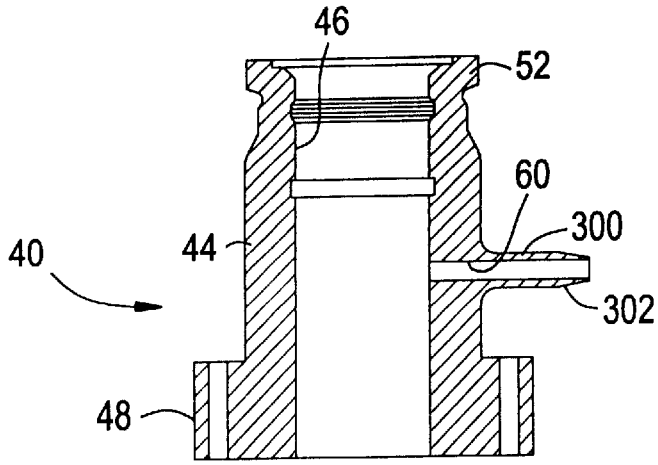
FIGS. 6*a* to 6*c* are side elevation cross-sectional views of injection spools according to further embodiments of the present invention.
Figure 6B:
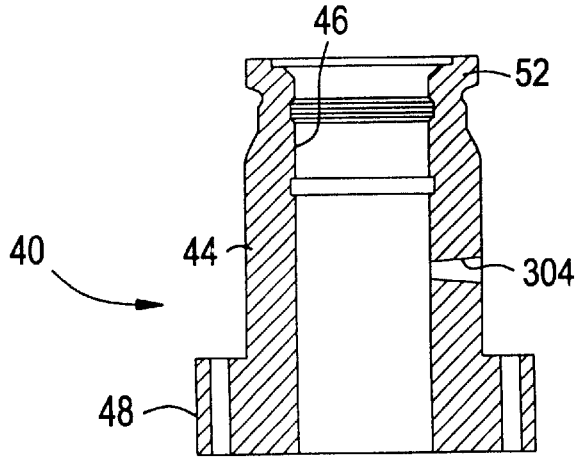
Figure 6C:
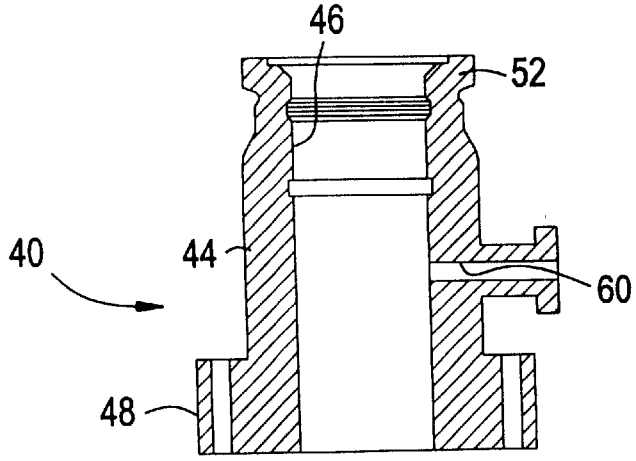

FIGS. 6*a* to 6*c* show further alternative arrangements for the connection of a riser interface assembly to the port in the injection housing of an injection spool of the present invention. In each of FIGS. 6*a* to 6*c*, an injection spool 40 is shown having an injection spool housing 44 as shown in FIGS. 1 and 2 and described above, with components of the injection spools of FIGS. 6*a* to 6*c* common to the injection spools of FIGS. 1 and 2 being indicated with the same reference numerals. Referring to FIG. 6*a*, an injection spigot 300 extends outwards from the injection spool housing 44 in communication with the port 60. The injection spigot terminates in a threaded male connector 302, to which a riser interface assembly may be connected using a corresponding female connector of conventional design.

Referring to FIG. 6*b*, the port in the injection spool housing 44 is formed as a threaded female connector portion, 304, to which a riser connector assembly may be attached using a corresponding male connector of known, conventional design.

Referring to FIG. 6*c*, an injection spigot 306 extends outwards from the injection spool housing 44 in communication with the port 60. The injection spigot terminates in a flange 308, which may be attached to a corresponding flange on a riser interface assembly, as previously described, with the use of an appropriate gasket or seal in a known manner.

From the detailed description of the embodiments of the present invention set out above, it can be seen that the apparatus of the present invention allows an existing subsea wellhead assembly to modified to accommodate fluid injection, such as the injection of a slurry of drilling cuttings, with little modification of the existing wellhead equipment being necessary. Alternatively, a wellhead assembly may be constructed on the seabed incorporating the injection spool of the present invention with no substantial modification to the components of the wellhead assembly conventionally employed. It is to be noted that a wellhead assembly incorporating the injection spool of the present invention can be constructed to have the injection riser interface assembly as a totally self contained unit, which allows the injection system of the present invention to be installed without needing to rely on other wellhead components, such as the presence of a guide base. Indeed, the apparatus of the present invention may be installed and the method of fluid injection operated without a guide base being present at the subsea location.

While the preferred embodiments of the present invention have been shown in the accompanying figures and described above, it is not intended that these be taken to limit the scope of the present invention and modifications thereof can be made by one skilled in the art without departing from the spirit of the present invention.

What we claim is:

1. An injection spool for use in the injection of a fluid into a wellhead assembly, the wellhead assembly having a central bore therethrough, the injection spool comprising:

an outer housing having a central bore therethrough, the housing having a first end for connection to a wellhead assembly such that the central bore of the housing is aligned with the central bore of the wellhead assembly;

an inner housing having a central bore therethrough, the inner housing being disposed within the central bore in the outer housing, whereby a cavity is formed between the inner housing and the outer housing;

a port in the outer housing having an opening into the cavity between the inner housing and the outer housing;

the inner housing having a portion extending from within the outer housing beyond the first end of the outer housing for forming a cavity within a wellhead assembly to which the injection spool is connected, the cavity thus formed connecting the cavity in the injection spool with an annular cavity defined by adjacent casings present in the wellhead assembly;

the first end of the outer housing comprises a connector for connecting the spool to a wellhead assembly;

the connector is for connecting the spool to a high pressure housing of a wellhead assembly; and, the portion of the inner housing extending from within the outer housing is formed to connect to a casing within the wellhead.

2. The injection spool as claimed in claim 1, wherein the portion of the inner housing extending from within the outer housing is formed to seal against a casing hanger secured within the wellhead assembly.

3. The injection spool as claimed in claim 1, wherein the inner housing is a sleeve secured at a first end within the central bore of the outer housing.

4. The injection spool as claimed in claim 3, wherein a seal is provided between the first end of the sleeve and the outer housing.

5. The injection spool as claimed in claim 3, wherein the sleeve is adapted to be secured at a second end within the central bore of the wellhead assembly.

6. The injection spool as claimed in claim 5, wherein the sleeve is adapted to be secured at a second end within a casing hanger located in the central bore of the wellhead housing.

7. The injection spool as claimed in claim 3, wherein the sleeve may be secured in the injection spool after the injection spool has been installed on a wellhead assembly.

8. The injection spool as claimed in claim 3, wherein the sleeve acts as a wear bushing for the injection spool and the portion of the wellhead assembly into which it extends, when the injection spool is installed on a wellhead assembly.

9. A wellhead assembly in a well, the wellhead assembly having a central bore therethrough in communication with the well, the wellhead assembly comprising:

a wellhead housing;

a first casing extending into the well;

a second casing extending within the first casing into the well;

an annular cavity defined between the first and second casings, through which access can be gained to a subsurface formation;

an injection spool housing connected at a first end to the wellhead housing and having a central bore therethrough in communication with the central bore of the wellhead assembly;

an inner housing extending from within the central bore of the injection spool housing into the central bore of the wellhead housing, the inner housing is a sleeve secured at a first end within the central bore of the injection spool housing and the sleeve connects at a second end to the second casing within the wellhead assembly;

a first cavity formed between the inner housing and the injection spool housing;

a second cavity formed between the inner housing and the wellhead housing and communicating with the first cavity and the annular cavity between the first and second casings;

a port in the injection spool housing opening into the first cavity; and, the wellhead housing is a high pressure housing.

10. The wellhead assembly as claimed in claim 9, wherein the first casing is supported within the wellhead assembly by a casing hanger.

11. The wellhead assembly as claimed in claim 9, wherein the second casing is supported within the wellhead assembly by a casing hanger.

12. The wellhead assembly as claimed in claim 11, wherein the casing hanger supporting the second casing has a bore therethrough to allow the second cavity to communicate with the annular cavity.

13. The wellhead assembly as claimed in claim 9, wherein the first end of the injection spool housing comprises a connector.

14. The wellhead assembly as claimed in claim 9, wherein a seal is disposed between the first end of the sleeve and the injection spool housing.

15. The wellhead assembly as claimed in claim 9, wherein the second end of the sleeve contacts a casing hanger supporting the second casing within the wellhead assembly.

16. The wellhead assembly as claimed in claim 9, wherein the sleeve acts as a wear bushing within the injection spool housing and the portion of the wellhead housing into which it extends.

17. The wellhead assembly as claimed in claim 9, further comprising a cuttings riser interface assembly connected to the port in the injection spool housing.

18. The wellhead assembly as claimed in claim 17, wherein the cuttings riser interface assembly comprises a valve for isolating the first cavity from the exterior of the wellhead assembly.

19. The wellhead assembly as claimed in claim 9, further comprising a blowout preventer stack installed on the injection spool housing.

20. A method for injecting drilling cuttings into an underground formation through a wellhead assembly having a central bore therethrough situated on a well in the formation, the method comprising:

providing an injection spool installed on the wellhead assembly, the injection spool having a central bore therethrough in communication with the central bore in the wellhead assembly;

providing a first cavity within the injection spool, while maintaining the central bore therethrough open;

providing a second cavity within the wellhead assembly in communication with the first cavity and an annular cavity between two adjacent casings extending from the wellhead assembly into the underground formation;

providing a port in the injection spool in communication with the first cavity;

injecting a slurry of the drilling cuttings through the port in the injection spool into the first cavity;

the injection of drilling cuttings occurs while well operations are conducted through the wellhead assembly; and, the injection of cuttings occurs while the well is being drilled.

* * * * *